US005234215A

United States Patent [19]

Uehara

[11] Patent Number: 5,234,215

[45] Date of Patent: Aug. 10, 1993

[54] GOLF PRACTICING RANGE

[76] Inventor: Yutaka Uehara, 3-D, 87-3, Sawada 1-chome, Fujiidera-shi, Osaka, Japan

[21] Appl. No.: 886,923

[22] Filed: May 22, 1992

[51] Int. Cl.[5] ..... A63B 69/36

[52] U.S. Cl. ..... 273/35 B; 273/178 B; 273/32 H

[58] Field of Search ..... 273/178 B, 35 B, 176 F, 273/176 FA, 176 FB, 181 R, 181 A, 32 H

[56] References Cited

U.S. PATENT DOCUMENTS 4,202,547 5/1980 Mueller ..... 273/178 B X

FOREIGN PATENT DOCUMENTS 1110919 7/1991 PCT Int'l Appl. ..... 273/35 B

*Primary Examiner*—George J. Marlo

*Attorney, Agent, or Firm*—Wenderoth, Lind & Ponack

[57] ABSTRACT

A golf practicing range has a guideway provided on a field and a putting green provided on the field. The green is movable intermittently along the guideway. At each tee there is provided a distance indicator which displays the distance from the tee to the green every time the green stops at a predetermined point on the guideway.

1 Claim, 2 Drawing Sheets

GOLF PRACTICING RANGE

BACKGROUND OF THE INVENTION

This invention relates to a golf practicing range which allows a golfer to check and learn the distance of shots hit with each of the clubs in one set.

A conventional golf practicing range is provided with a plurality of drive distance indicator plates at predetermined points in the field stretching in front of the teeing areas. It also has a plurality of putting greens located in fixed predetermined positions for practicing approach shots.

In such a conventional golf practicing range, the distances between the teeing areas and each drive distance indicator plate are not the same but differ. Thus, the drive distance indicator plates cannot tell the golfer the exact drive distance. In other words, it is impossible for the golfer to check the distance of shots hit with each of his clubs.

Further, in practicing the approach to the green, not only is it impossible for the golfer to check the distance from the teeing point to the green, it is also impossible to practice approach shots using every one of the clubs in one set because the distance from the teeing area to the green is fixed.

SUMMARY OF THE INVENTION

It is therefore an object of this invention to provide a golf practicing range which provides the golfer with the distance from the teeing area to the green with high accuracy and which allows the golfer to check and accurately learn the distance of shots hit with each one of his clubs.

According to this invention, in order to achieve the above object, there is provided a golf practicing range comprising a guideway provided on a field, a putting green provided on the field and movable intermittently along the guideway, and a distance indicator provided at each tee for displaying the distance from the tee to the green every time the green stops at a predetermined point on the guideway.

The distance indicator at each tee indicates the distance from the tee to the green with high accuracy, so that the golfer can check the distance of his shot accurately. Since the green moves intermittently at predetermined time intervals and the distance form the tee to the green is indicated every time the green stops, the golfer can practice approach shots using every one of the clubs and can check the distance for the shots hit with each of the clubs.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

Figure 1:
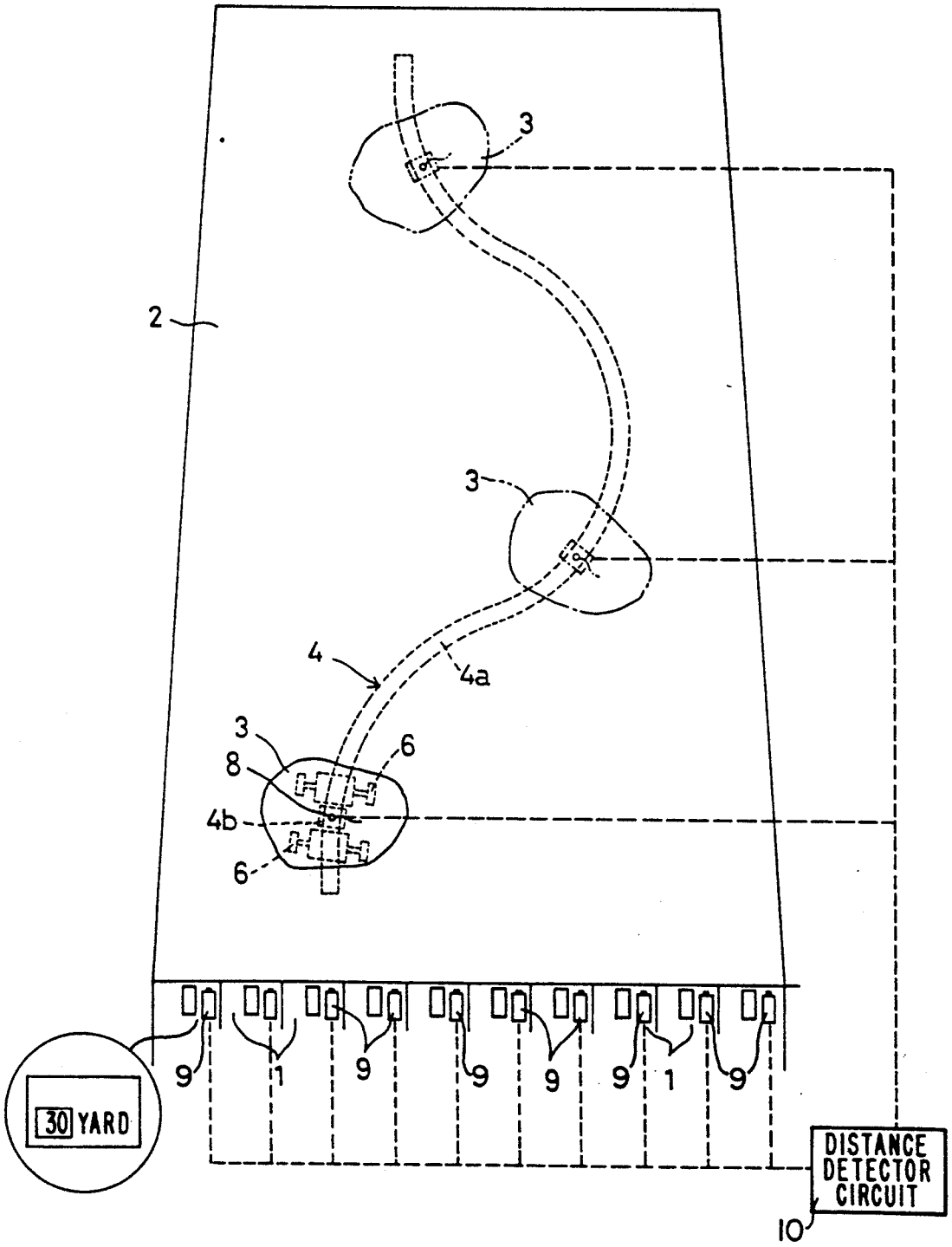
FIG. 1 is a plan view of the golf practicing range embodying this invention.

In FIG. 1, the golf practicing range comprises a plurality of transversely arranged tees 1, a field (fairway) 2 stretching in front of the tees 1, and a putting green 3 provided on the field 2 so as to be movable intermittently along a guideway 4.

Figure 2:
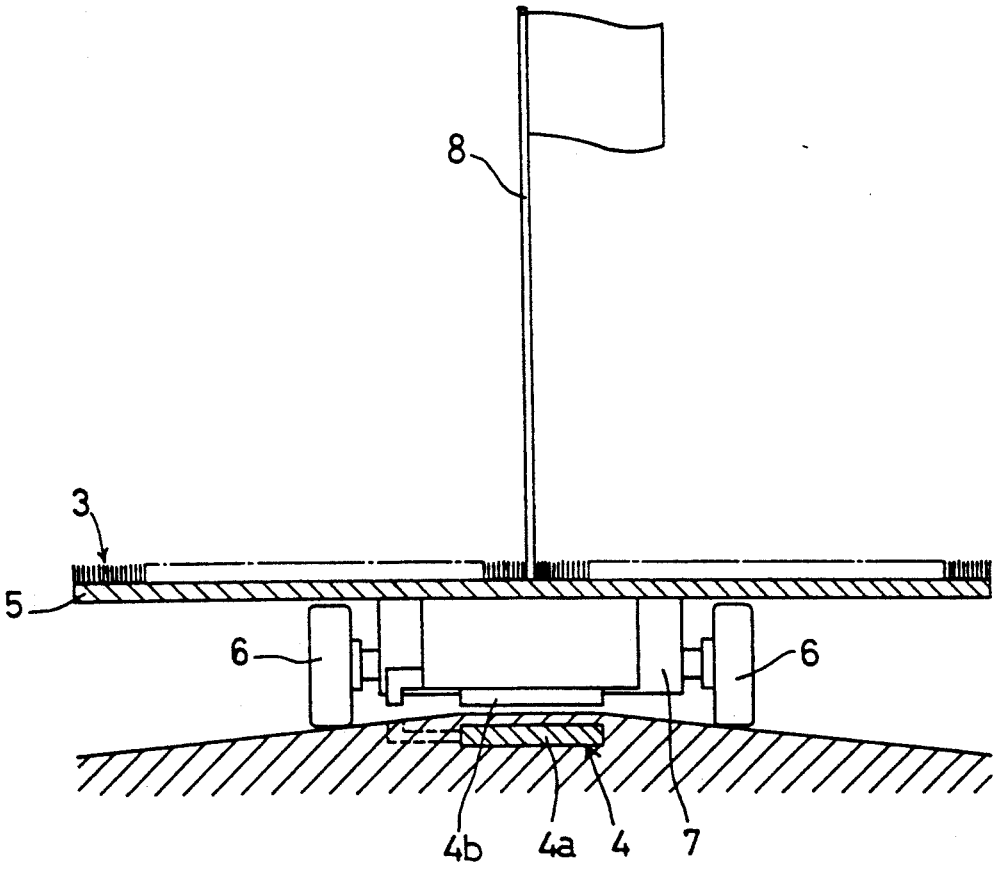
FIG. 2 is an enlarged sectional view of a portion of the same.

As shown in FIG. 2, the green 3 is on a flat plate 5 having a predetermined shape and size and supported on wheels 6. The green 3 is movable on the field 2 along the guideway 4 by driving the wheels 6 with a drive unit 7 such as a motor.

In the embodiment, the guideway 4 comprises a guide rail 4*a* having straight and/or curved portions and embedded in the ground, and a guide rail detector 4*b* mounted on the bottom of the green 3. By controlling the drive unit 7 and the wheels 6, the green 3 is moved along the guide rail 4*a*.

Along the guideway 4, there are provided, at predetermined intervals and at predetermined points, a plurality of switches for detecting and stopping the green 3. The green 3 is adapted to stop at every switch and restart after a predetermined time which is set by a timer.

The guideway 4 is not limited to having the illustrated structure but may be in the form of a rail laid on the field 2 or a guide groove formed in the field. In this case, the green 3 may be self-propelled or chain-driven so as to be intermittently reciprocable along the rail or guide groove.

At each tee 1 there is a distance indicator 9 for indicating the distance between the tee and the center of the green, e.g. a pin 8 on the green 3.

The distance indicator 9 at each tee 1 indicates, in cooperation with the switch at and by which the green 3 is stopped, the distance from the tee 1 to the center of the green 3 in meters or yards with high accuracy.

The distance may be detected with an electrical circuit 10 or may be detected optically by means of a light emitter and receptor provided at each tee and a reflector provided on the green.

In practice, the golfer hits the ball placed at each tee 1 toward the green 3 on the field.

Since the exact distance from the tee 1 to the center of the green 3 is indicated on the distance indicator 9, the golfer can gain accuracy in his approach shots.

The putting green 3 moves intermittently at predetermined time intervals along the guideway 4 as shown in FIG. 1, so that the distance and position from each tee 1 to the green 3 will change. Every time the green 3 stops, the distance from the tee 1 to the green 3 is indicated on the indicator 9.

This allows the golfer to practice approach shots using clubs with different numbers and to check the distance of shots hit with each club. Thus, he can simulate approach shots to be used on an actual golf course.

What is claimed is:

1. A golf practice range comprising: a plurality of tees; a field extending in front of said tees; a guide rail embedded in and entirely disposed under the surface of said field; a putting green disposed on said field; a guide rail detector mounted on said putting green to detect the guide rail; drive means, mounted to said putting green and operatively connected to said guide rail detector, for propelling said putting green intermittently along said guide rail; distance detector means for detecting the actual distances between each of said tees and said putting green; and distance indicators disposed at said plurality of tees, respectively, said distance indicators operatively connected to said distance detector means so as to respectively display said actual distances between the tees at which the indicators are located and said putting green.

* * * * *